US007466950B2

(12) United States Patent
Matsuura et al.

(10) Patent No.: US 7,466,950 B2
(45) Date of Patent: Dec. 16, 2008

(54) IMAGE HEATING APPARATUS WITH RELATED IMAGE HEATING MEMBER AND HEAT PIPE

(75) Inventors: Daigo Matsuura, Toride (JP); Yasuhiro Hayashi, Moriya (JP); Ikuo Nakamoto, Toride (JP); Kazuhiro Hasegawa, Toride (JP); Shigeaki Takada, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 11/566,387

(22) Filed: Dec. 4, 2006

(65) Prior Publication Data

US 2007/0127958 A1 Jun. 7, 2007

(30) Foreign Application Priority Data

Dec. 6, 2005 (JP) ..... 2005-352344

(51) Int. Cl.
*G03G 15/20* (2006.01)

(52) U.S. Cl. ..... 399/328; 399/329; 399/330

(58) Field of Classification Search ..... 399/320, 399/328, 329, 330; 347/156
See application file for complete search history.

(56) References Cited

U.S. PATENT DOCUMENTS

| | | | | |
|---|---|---|---|---|
| 6,021,303 | A | 2/2000 | Terada et al. | 399/328 |
| 6,463,252 | B2 | 10/2002 | Omoto et al. | 399/330 |
| 6,989,516 | B1 * | 1/2006 | Domoto | 399/328 X |
| 7,030,345 | B2 * | 4/2006 | Nishihara et al. | 399/328 X |
| 7,058,346 | B2 * | 6/2006 | Domoto et al. | 399/328 |
| 7,095,973 | B2 * | 8/2006 | Kwak | 399/328 |
| 7,200,354 | B2 | 4/2007 | Nakamoto et al. | 399/329 |
| 7,257,360 | B2 * | 8/2007 | Domoto et al. | 399/328 |
| 7,263,306 | B2 | 8/2007 | Hayashi | 399/70 |
| 2006/0127142 | A1 | 6/2006 | Nakamoto et al. | 399/329 |
| 2007/0059065 | A1 | 3/2007 | Takada et al. | 399/329 |
| 2007/0140760 | A1 | 6/2007 | Nakamoto et al. | 399/329 |
| 2007/0223979 | A1 | 9/2007 | Jinzai et al. | 399/333 |
| 2007/0231026 | A1 | 10/2007 | Hayashi et al. | 399/329 |

FOREIGN PATENT DOCUMENTS

| | | |
|---|---|---|
| JP | 9-197863 | 7/1997 |
| JP | 2000-035724 | 2/2000 |
| JP | 2002-023533 | 1/2002 |

* cited by examiner

*Primary Examiner*—Sandra L Brase
(74) *Attorney, Agent, or Firm*—Fitzpatrick, Cella, Harper & Scinto

(57) ABSTRACT

An image heating apparatus includes a coil for generating magnetic flux and an image heating member. The image heating member comprises an electroconductive layer which generates heat by eddy current generated by the magnetic flux from the coil, for heating an image on a recording material. The image heating apparatus further comprises an energization control device for controlling energization of the coil so that a temperature of the image heating member is a predetermined temperature Tf (° C.), and a heat pipe contactable with the image heating member. The electroconductive layer has a Curie temperature Tc so that the relation Tf≦Tc≦Tf+Qmax (W)×Rh (° C./W) is satisfied, wherein Qmax (W) represents a maximum amount of heat transport, and Rh (° C./W) represents a value of heat resistance of the heat pipe at a dryout occurrence temperature of the heat pipe.

9 Claims, 13 Drawing Sheets

IMAGE HEATING APPARATUS WITH RELATED IMAGE HEATING MEMBER AND HEAT PIPE

FIELD OF THE INVENTION AND RELATED ART

The present invention relates to an image heating apparatus, such as a fixing apparatus for fixing an unfixed image on a recording material or a gloss-increasing apparatus for increasing gloss of an image by heating the image fixed on a recording material.

In the following description, a sheet (paper) width of a recording material is a dimension of the recording material in a direction perpendicular to a recording material conveyance direction. A large-size recording material is a recording material, having a maximum sheet width, capable of passing through the image heating apparatus. A small-size recording material is a recording material having a sheet width smaller than that of the large-size recording material. An axial direction, a longitudinal direction, a width direction, or width of respective constitutional members of the apparatus are directions parallel to a direction perpendicular to the recording material conveyance direction at a recording material conveyance passage surface or a dimension in these directions.

In recent years, a fixing apparatus using an induction heating method has been employed as a fixing apparatus used in an electrophotographic image forming apparatus such as a copying machine, a printer, or a facsimile machine. The induction heating method is a method in which magnetic flux is generated by passing current through a coil and caused to act on an image heating member having an electroconductive layer, thereby to generate eddy current in the electroconductive layer to generate heat. In such an induction heating method, heat is directly generated from the image heating member, so that the induction heating method is effective in reducing a warming-up time (WUT).

On the other hand, the induction heating method capable of reducing the WUT is required to solve such a problem that a temperature at an end portion of a fixing member such as a roller or a belt in an axial direction or width direction is excessively increased when a small-size recording material is passed through the fixing member (non-sheet-passing portion temperature rise).

A belt fixing apparatus and heating roller fixing apparatus which are capable of reducing a temperature distribution of the fixing member in a sheet passing area and non-sheet-passing area of the recording material by means of a heat pipe to permit stable fixation have been known as a countermeasure against the non-sheet-passing portion temperature rise (Japanese Laid-Open Patent Application (JP-A) Hei 9-197863). This method is referred to as a "heat pipe method".

Further, in a constitution using the induction heating method, the following countermeasures to prevent the non-sheet-passing portion temperature rise have also been known.

In an image heating apparatus for heating a heat generation member having a magnetic layer by exciting or energizing the magnetic layer, a Curie temperature (point) is set to be close to a fixing temperature so that the heat generation member has a heat generating rate at a temperature not less than the Curie temperature is ½ or less of that a normal temperature. As a result, the heat generation member possesses self temperature controllability, thus effecting stable temperature control to alleviate the non-sheet-passing portion temperature rise in a fixing apparatus (JP-A 2000-035724). Further, there has been known a fixing apparatus capable of alleviating the non-sheet-passing portion temperature rise by using a material, for a heat generation member, having a Curie temperature which is higher than a set fixing temperature and lower than a heat-resistant temperature of the fixing apparatus (JP-A 2002-23533). These methods are referred to as a "magnetism-adjusted alloy method".

As described above, as a method of preventing excessive temperature rise at the non-sheet-passing portion, setting of the Curie temperature to be close to an upper limit of the non-sheet-passing portion temperature rise is effective since it is possible to suppress a rise in temperature not less than the Curie temperature in a small degree.

In this case, when the temperature of the heat generation roller reaches the Curie temperature, heat generation can be suppressed but it is not completely terminated at the Curie temperature, so that when a small-size recording material is continuously passed through the fixing apparatus, the temperature of the heat generation roller is somewhat increased at the non-sheet-passing portion to cause a temperature difference between the sheet passing portion and the non-sheet-passing portion. Then, when a large-size recording material is passed through the fixing apparatus before the temperature distribution is eliminated, there has been a possibility that an irregularity in gloss between the sheet passing portion and the non-sheet-passing portion is caused to occur.

In order to quickly eliminate the above described temperature distribution, it can be considered that the heat pipe method is used in combination with the magnetism-adjusted alloy method to prevent the non-sheet-passing portion temperature rise and quick temperature uniformization after the passing of the small-size recording material.

However, when the heat pipe is used, operating fluid in the heat pipe is partially dried out in some cases depending on a setting temperature by the Curie temperature before the non-sheet-passing portion temperature reaches the setting temperature. When the dryout is caused to occur, a heat transporting ability is lowered, so that the temperature uniformizing effect is inhibited. As a result, there has arisen such a problem that the temperature distribution occurring after the continuous passing of the small-size recording material cannot be eliminated quickly.

SUMMARY OF THE INVENTION

A principal object of the present invention is to provide an image heating apparatus, using a magnetism-adjusted alloy method and a heat pipe method in combination, capable of preventing a non-sheet-passing portion temperature rise and quickly alleviating a difference (distribution) of temperature in a longitudinal direction of an image heating member without causing dryout of a heat pipe.

According to an aspect of the present invention, there is provided an image heating apparatus, comprising:

a coil for generating magnetic flux;

an image heating member, comprising an electroconductive layer which generates heat by eddy current generated by the magnetic flux from the coil, for heating an image on a recording material;

energization control means for controlling energization of the coil so that a temperature of the image heating member is a preliminarily set image heating temperature Tf (° C.); and a heat pipe contactable with the image heating member, wherein the electroconductive layer has a Curie temperature Tc satisfying the following relationship:

$$Tf \leqq Tc \leqq Tf + Q\max(W) \times Rh \ (^\circ\ C./W),$$

wherein Qmax (W) represents a maximum amount of heat transport, and Rh (° C./W) represents a value of heat resistance of the heat pipe immediately after an occurrence of dryout.

According to another aspect of the present invention, there is provided an image heating apparatus, comprising:

a coil for generating magnetic flux;

an image heating member, comprising an electroconductive layer which generates heat by eddy current generated by the magnetic flux from the coil, for heating an image on a recording material;

energization control means for controlling energization of the coil so that a temperature of the image heating member is a preliminarily set image heating temperature Tf (° C.); and a heat pipe contactable with the image heating member, wherein the electroconductive layer has a Curie temperature which is not less than the image heating temperature and is not more than a dryout occurrence temperature of the heat pipe when a part of the heat pipe is temperature-controlled to have the image heating temperature.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, embodiments of the present invention will be described with reference to the drawings.

Embodiment 1

(1) Example of Image Forming Apparatus

Figure 1:
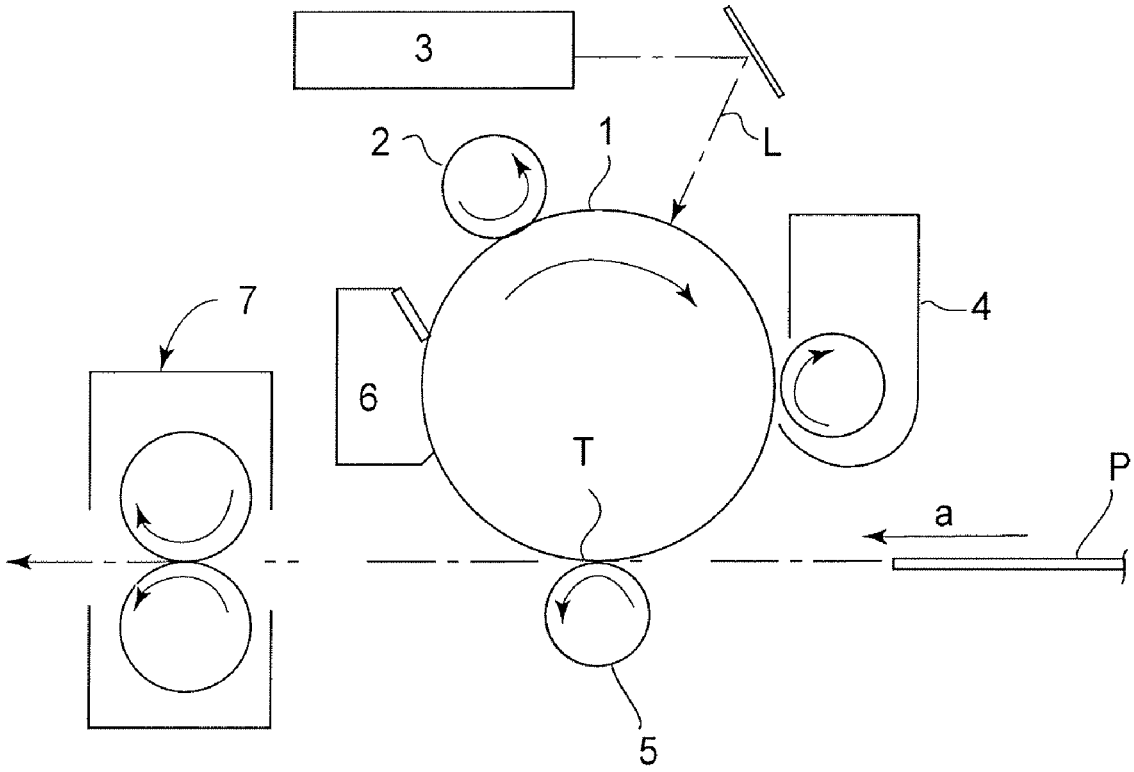
FIG. 1 is a schematic illustration of an embodiment of an image forming apparatus in Embodiment 1.

FIG. 1 is a schematic view showing an example of an image forming apparatus employing an image heating apparatus, as fixing apparatus, in accordance with the present invention, showing the general structure thereof. An image forming apparatus 100 of this embodiment is a laser printer, which uses a transfer-type electrophotographic process.

Designated by referential numeral 1 is a rotation drum-type electrophotographic photosensitive member (hereinafter referred to as "a photosensitive drum") as an image bearing member, which is rotationally driven in the clockwise direction indicated by an arrow, at a predetermined peripheral speed.

Designated by a referential numeral 2 is a charge roller, as a charging means, of the contact type, which uniformly charges electrically an outer peripheral surface of the rotating photosensitive drum 1 to predetermined polarity and potential level.

Designated by a referential numeral 3 is a laser scanner as an exposing means, which scans the uniformly charged peripheral surface of the rotating photosensitive drum 1 by emitting a beam of laser light L while modulating it with electrical signals corresponding to image information. As a result, an electrostatic latent image is formed in a pattern corresponding to a scanning exposure pattern on the peripheral surface of the photosensitive drum 1.

Designated by a referential numeral 4 is a developing apparatus, which normally or reversely develops the electrostatic latent image on the peripheral surface of the photosensitive drum 1, into a toner image.

Designated by a referential numeral 5 is a transfer roller as a transferring means, which is pressed against the peripheral surface of the photosensitive drum 1 at a predetermined pressing force to form a transfer nip (portion) T, to which a recording material P is conveyed from an unshown sheet feeding/conveying mechanism at a predetermined control timing, and then, is nipped and conveyed through the transfer nip T between the photosensitive drum 1 and the transfer roller 5. A predetermined transfer bias is applied to the transfer roller 5 at predetermined control timing. As a result, the toner image on the peripheral surface of the photosensitive drum 1 is electrostatically transferred successively onto the surface of the recording material P.

After being conveyed out of the transfer nip T, the recording material P is separated from the peripheral surface of the photosensitive drum 1, and introduced into the fixing apparatus 7, which fixes the unfixed toner image on the recording material P by applying heat and pressure to the introduced recording material and the unfixed toner image thereon; it turns the unfixed image into a permanent fixed image. After the fixation, the recording material P is conveyed out of the fixing apparatus.

Designated by a referential numeral 6 is a device for cleaning the photosensitive drum 1, which removes the transfer residual toner remaining on the peripheral surface of the photosensitive drum 1 after the separation of the recording material P from the peripheral surface of the photosensitive drum 1. After the cleaning of the peripheral surface of the photosensitive drum 1, the peripheral surface of the photosensitive drum 1 is repeatedly subjected to subsequent image formation.

The direction indicated by a reference symbol a is the direction in which the recording material P is conveyed. The image forming apparatus, the recording medium P is fed and conveyed through the fixing apparatus so that the center line of the recording material P is kept aligned with the center of a fixing roller (center line-based sheet passing).

(2) Fixing Apparatus 7

Figure 2:
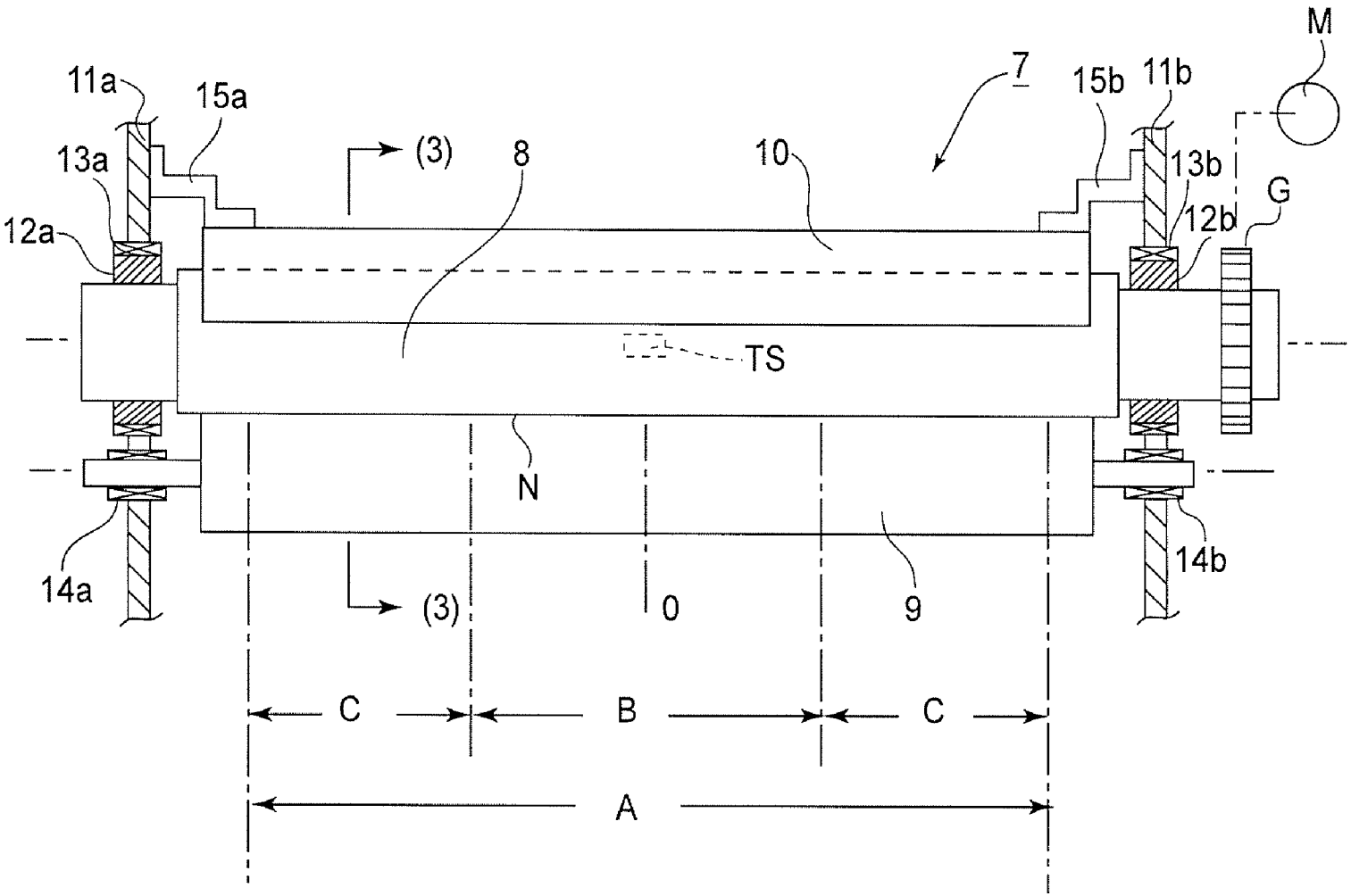
FIG. 2 is a schematic front view showing a principal portion of a fixing apparatus in Embodiment 1.
Figure 3:
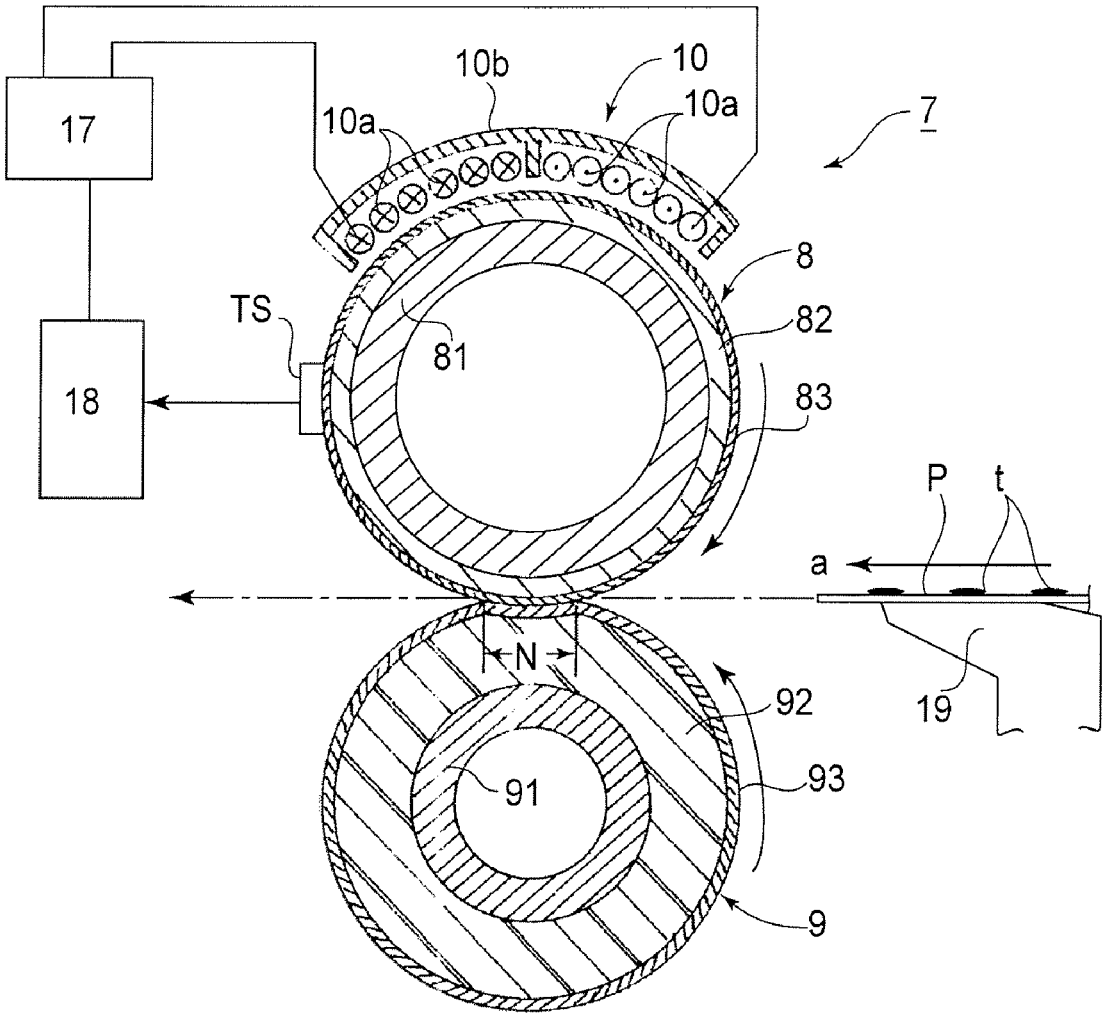
FIG. 3 is an enlarged sectional view taken along (3)-(3) line shown in FIG. 2.

FIG. 2 is a schematic front view of a principal portion of the fixing apparatus, and FIG. 3 is an enlarged schematic cross-sectional view taken along (3)-(3) line shown in FIG. 2.

The fixing apparatus 7 is an apparatus of a heating roller fixation type and causes no increase in warming-up time. Further, even when a small-size recording material having a sheet width (size) smaller than a width of a heating member is continuously passed through the fixing apparatus and thereafter a large-size recording material having a sheet width (size) larger than that of the small-size recording material is passed through the fixing apparatus, it is possible to prevent an occurrence of image failure such as hot offset.

A heating roller (fixing roller) 8 as a heat generation member (image heating member) is rotatably supported between a front fixing side plate 11*a* and a rear fixing side plate 11*b* at front and rear end portions thereof via heat insulating bushes 12*a* and 12*b* and bearings 13*a* and 13*b*. At the rear end portion of the heating roller 8, a drive gear G is secured.

Below the heating roller 8, a pressing roller 9 as a pressing member is disposed in parallel to the heating roller 8. The pressing roller 9 is rotatably supported between the front and rear fixing side plates 11*a* and 11*b* at its front and rear end portions via bearings 14*a* and 14*b*. The pressing roller 9 is pressed against the lower surface of the heating roller 8, while being resistant to elasticity of an elastic layer of the pressing roller, by an unshown pressing mechanism. As a result, between the pressing roller 9 and the heating roller 8, a fixing nip (heating nip) N having a predetermined width is created in a recording material conveyance direction.

On the heating roller 8, magnetic flux is caused to act by an induction coil unit 10 as a magnetic flux generating means to generate heat. The induction coil unit 10 is disposed above and opposite to the heating roller 8 with a slight spacing while being kept in parallel and noncontact with the heating roller 8. The induction coil unit 10 is secured and supported by the front and rear fixing side plates 11*a* and 11*b* via brackets 15*a* and 15*b*.

The heating roller 8 is rotationally driven in a clockwise direction indicated by an arrow shown in FIG. 3 at a predetermined speed by transmitting a rotational force from a drive motor M to the drive gear G through an unshown power transmission mechanism. The pressing roller 9 is rotated in a counterclockwise direction in an indicated arrow direction by the rotational drive of the heating roller 8. An AC current (high-frequency current) is carried from a high-frequency inverter (exciting circuit) 17 to induction coils (electromagnetic induction heating coils) 10*a* of the induction coil unit 10, so that an AC magnetic field is generated to increase a temperature of the heating roller 8 by electromagnetic induction heating. The surface temperature of the heating roller 8 is detected by a temperature sensor (such as a thermistor) TS as a temperature detection means disposed in contact or noncontact with the heating roller 8. Then, electrical information about the detection temperature of the temperature sensor TS is inputted into a control circuit 18. The control circuit 18 controls electric power supplied from the high-frequency inverter 17 to the induction coils 10*a* so that the electrical information about the detection temperature inputted from the temperature sensor TS is kept at a substantially constant value. As a result, the surface temperature of the heating roller 8 is temperature-controlled at a predetermined fixing temperature (a target temperature during image heating).

Then, the recording material P onto which the toner image (or color toner image) t has been transferred at the transfer nip T of the image forming portion as described above, is introduced into the fixing nip N by being guided through an entrance guide plate 19. The toner image on the recording material P is fixed as a permanent fixed image under heating by the heating roller 8 and pressure in the fixing nip N during the nipping and conveyance of the recording material P in the fixing nip N.

(2-1) Heating Roller 8

In this embodiment, the heating roller 8 is constituted as a roller member having an outer diameter of approximately 10 mm and a three-layer structure consisting of a heat pipe 81, a magnetism-adjusted alloy layer (electroconductive layer) 82 as a heat generation layer, and a surface coating layer 83 in this order from an inner side to an outer side.

The heat pipe 81 includes a cylindrical pipe formed of copper, Al, iron, etc., in a thickness of about 1 mm and operating fluid such as water or alcohol contained in the cylindrical pipe.

The magnetism-adjusted alloy layer 82 is a cylindrical roller formed by magnetism-adjusted alloy comprising a material such as iron, nickel, chromium, or manganese in a thickness of about 0.5 mm so that a Curie temperature is a predetermined temperature. In this embodiment, the Curie temperature is adjusted by adjusting an amount of chromium to be mixed.

The surface coating layer 83 is a layer coated on an outer peripheral surface of the magnetism-adjusted alloy layer 82. In this embodiment, a coating layer formed of perfluoroalkoxy (PFA) material in a thickness of about 20 μm.

By constituting the material for the heat pipe 81 itself with a magnetism-adjusted alloy material, it is also possible to constitute the heating roller 8 having a lower thermal capacity. More specifically, the cylindrical pipe of the heat pipe 81 is constituted by an induction heat generation member having a Curie temperature which is an image heating temperature or more and a heat-resistant temperature or less of the apparatus or by an induction heat generation member having such a temperature characteristic that there is a temperature range in which an electric resistance value is decreased with an increasing temperature and that the electric resistance value reaches a maximum between the image heating temperature and the heat-resistant temperature of the apparatus.

A width of the heat pipe in its longitudinal direction is larger than a width of the recording material, passing through the fixing device, in a direction perpendicular to the recording material conveyance direction. In this embodiment, the heating roller and the heat pipe have the same length but the present invention is not limited thereto.

Further, in order to obtain a high-quality fixed image such as a color image, it is also possible to provide a heat-resistant elastic layer such as a silicon rubber layer between the magnetism-adjusted alloy layer 82 and the coating layer 83.

(2-2) Pressing Roller 9

The pressing roller 9 is, e.g., constituted as a soft roller, having an outer diameter of about 10 mm, including a cylindrical metal pipe 91 as a core metal formed of steed materials such as STKM (carbon steel tubes for machine structural purposes) or aluminum materials in a thickness of about 2 mm and thereon a heat-resistant elastic layer 92 and a release layer 93. The heat-resistant elastic layer 92 is formed as a silicon rubber layer having a thickness of about 2-3 mm. The release layer 93 is a PFA tube having a thickness of about 50 μm.

(2-3) Induction Coil Unit 10

The induction coil unit 10 includes a magnetic core material (magnetic core) 10*b* and induction coils 10*a*. The magnetic core material 10*b* is formed with a ferrite core or a lamination core. The induction coils 10*a* and constituted by a plurality of wound copper wires having a surface melting layer and insulating layer. More specifically, as the copper wires for the induction coils 10*a*, e.g., Litz wire is used. The induction coil unit 10 is an elongated thin plate-like member formed by integrally molding the induction coils 10*a* comprising Litz wire spirally wound in an elongated flat sheet-like shape and the magnetic core material 10*b* coated on the induction coils 10*a* with the use of electrically insulating resin.

The induction coil unit 10 is disposed opposite to the heating roller 8 with a predetermined spacing on a side opposite from the pressing roller 9 and is fixedly supported by the front and rear fixing side plates 11*a* and 11*b* via the brackets 15*a* and 15*b*. In other words, the induction coil unit 10 is disposed to surround a part of the outer peripheral surface of the heating roller 8.

(2-4) Alleviation of Non-sheet-passing Portion Temperature Rise by Heat Pipe 81

In FIG. 2, A represents a sheet passing area width of a recording material, having a maximum sheet width, capable of passing through the fixing apparatus 7. This recording material having the sheet width corresponding to the sheet passing area width A is referred to as a large-size recording material. As described above, in the image forming apparatus of this embodiment, the passing of the recording material is effected so that the center line of the recording material is kept aligned with the center of the fixing roller (center line-based sheet passing). In FIG. 2, O represents the center line (phantom line) for the passing of the recording material. B represents a sheet passing area width of a small-size recording material having a sheet width smaller than that of the large-size recording material. C represents an area width corresponding to a difference between the large-size recording material sheet passing width A and the small-size recording material sheet passing width B, i.e., a non-sheet-passing area width created in a plane of the recording material conveyance passage when the small-size recording material is passed through the fixing apparatus 7. The non-sheet-passing area width C is created on both sides of the small-size recording material sheet passing width B as shown in FIG. 2 since the passing of the recording material is effected according to the center line-based sheet passing. The non-sheet-passing area width varies depending on the sheet width of the small-size recording material to be passed through the fixing apparatus 7.

The induction coil unit 10 causes the heating roller 8 somewhat wider than the large-size recording material sheet passing width A to generate heat by induction heating even when the small-size recording material is passed through the fixing apparatus 7. The above described temperature sensor TS detects a temperature of the heating roller 8 at a portion corresponding to a portion of the small (minimum)-size recording material within its sheet passing area as the recording material passing area even when a recording material having any size (of the large and small sizes), thus effecting temperature control of the heating roller 8. For this purpose, when the small-size recording material is conveyed, heat of the heating roller 8 at a portion corresponding to the non-sheet-passing area widths C is accumulated since it is not consumed for heating the recording material. Further, by passing the small-size recording material continuously through the fixing apparatus 7, the heating roller 8 has a temperature distribution such that only the non-sheet-passing portions in a longitudinal direction (perpendicular to the sheet passing direction) of the heating roller 8 have a high temperature (non-sheet-passing portion temperature rise phenomenon).

The heat pipe 81 disposed inside the heating roller 8 has the function of alleviating this non-sheet-passing portion temperature rise phenomenon. More specifically, in the case where such a temperature distribution that only the non-sheet-passing portions of the heat pipe 81 in the longitudinal direction is caused as a result of the occurrence of the non-sheet-passing portion temperature rise phenomenon during the continuous passing of the small-size recording material operation fluid evaporates or vaporizes at the non-sheet-passing portions as a high-temperature portion to generate vapor flow. The vapor flow is moved toward the low-temperature portion (sheet passing portion) at high speed. As a result, heat transfer from the high-temperature portion to the low-temperature portion is effected at high speed. At the low-temperature portion, the vapor flow is cooled and condensed, thus being transported to the high-temperature portion through a capillary structure disposed along an inner wall of the heat pipe 81.

The above operation is continuously repeated, whereby it is possible to realize efficient heat transfer from the high-temperature portion to the low-temperature portion.

In this embodiment, the heat pipe 81 has a pipe diameter (ϕ) of about 8 mm and a wall thickness of 1 mm and is formed of copper. In the heat pipe 81, water is accommodated as the operating fluid. With respect to the pipe diameter of the heat pipe 81, when it is excessively small, a sufficient temperature uniformizing effect cannot be achieved during the operation of the heat pipe 81. On the other hand, when the pipe diameter is excessively large, a production cost and heat capacity of the heat pipe 81 are increased, so that a start up time is slow. For these reasons, the heat pipe 81 may desirably have a pipe diameter of 3 mm or more and 40 mm or less.

Figure 4:
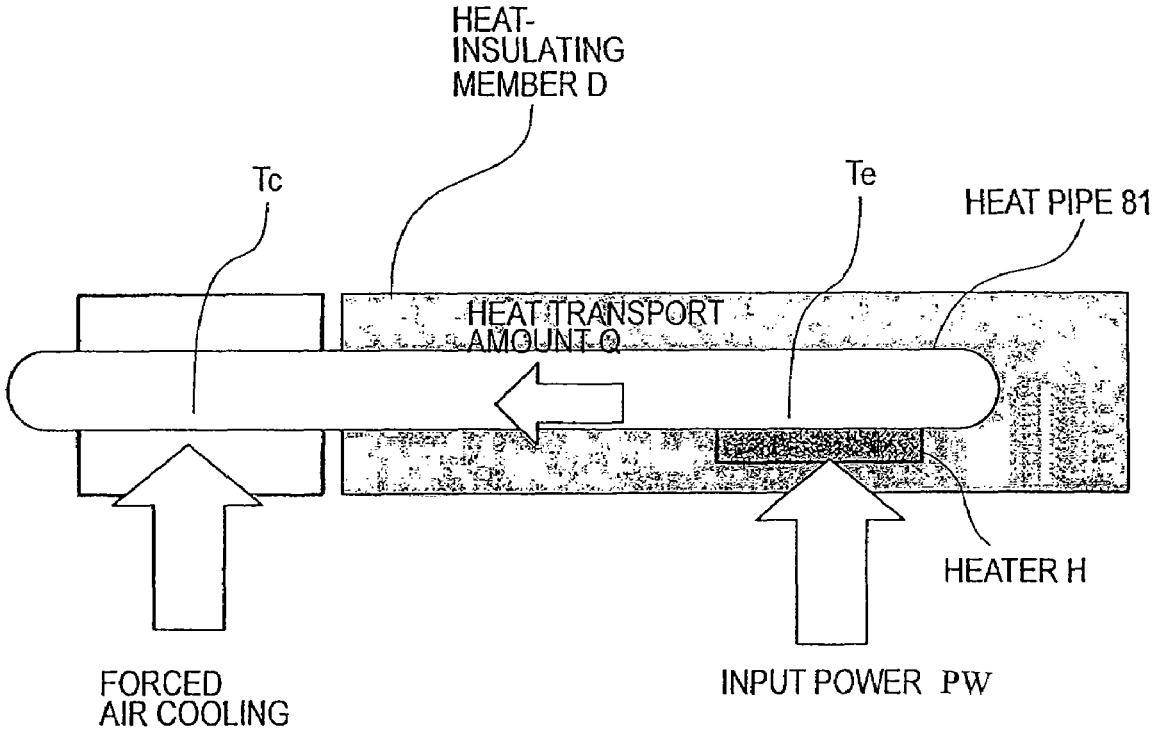
FIG. 4 is a schematic illustration of an experimental apparatus for evaluation of a characteristic of a heat pipe.

Here, in order to confirm the operation of the heat pipe 81, a heat resistance and a maximum of heat transport are measured by a measuring apparatus shown in FIG. 4. In order to effect evaluation in an environment closest to an actual operation environment, measurement is effected in such a manner that the heat pipe 81 is operated in a horizontal heat mode and a forced cooling portion is kept at about 190° C. close to a fixing temperature.

The heat resistance is one of most important characteristic values of the heat pipe 81 and represents a difficulty in transporting or transferring heat of the heat pipe 81. A heat resistance R (° C./W) is represented by the following formula (1):

$$R=(Te-Tc)/Q \quad (1)$$

In FIG. 4, Te (° C.) represents a temperature of an evaporation portion of the heat pipe 81, Tc (° C.) represents a temperature of a condensation portion of the heat pipe 81 Q (W) represents an amount of heat transport of the heat pipe 81, PW (W) represents electric power inputted into a heater H, and D represents a heat-insulating member.

The heater H is thermally insulated, so that it is assumed that the input power PW (W) into the heater H is substantially equal to the heat transport amount Q (W) of the heat pipe 81.

Figure 5:
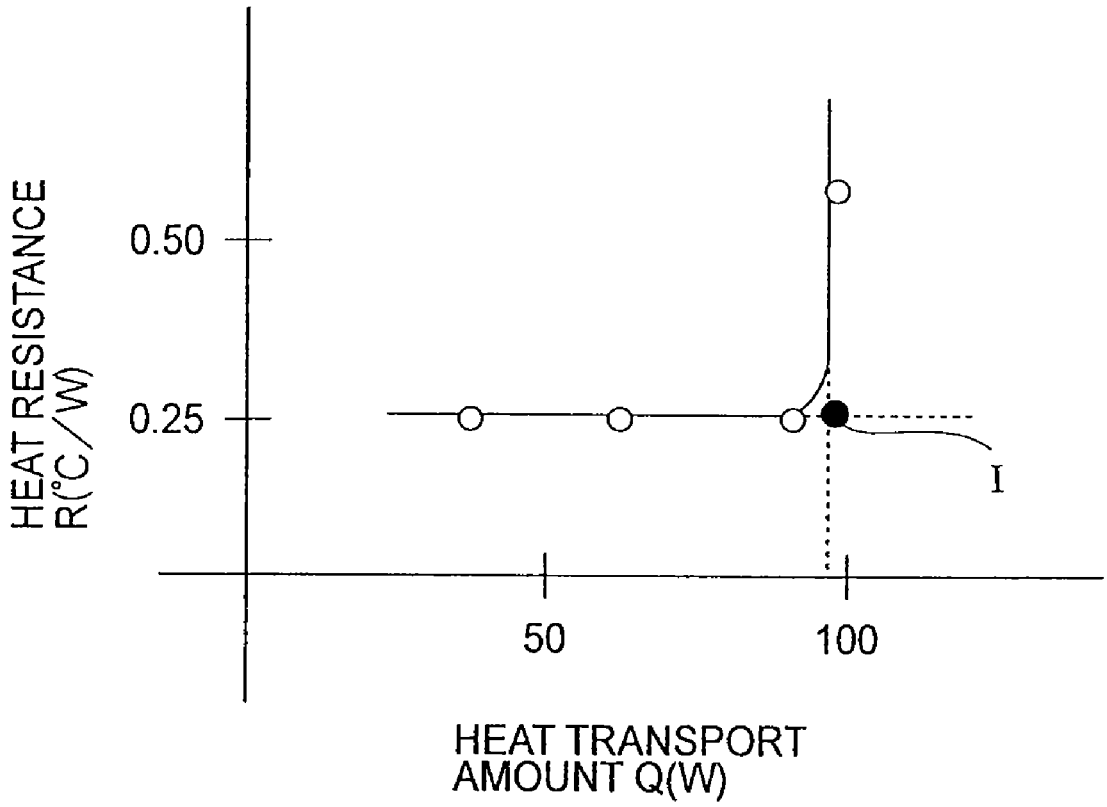
FIG. 5 is a graph showing a relationship between an amount of heat transport (transfer) and heat resistance of the heat pipe.

A relationship between the heat transport amount Q (W) and heat resistance R (° C./W) of the heat pipe 81 in this case is shown in FIG. 5. As shown in FIG. 5, the heat resistance R (° C./W) is abruptly increased from a point close to a heat transport amount Q of 100 W. This is because when the heat transport amount exceeds a certain value, water as the operating fluid is dried out at the evaporation portion to disturb the above described cycle of the evaporation and condensation in the heat pipe 81, thus leading to an increase in heat resistance. In this case, a maximum of heat transport amount at which the heat pipe 81 can function without causing dryout of water is referred to as a maximum heat transport amount Qmax.

When a heat resistance at a heat transport amount not more than the maximum heat transport amount Qmax is taken as Rh, a temperature difference ΔTmax by which the dryout (of water) in the heat pipe 81 is caused to occur is represented, from the formula (1), by the following formula (2):

$$\Delta T\max = Te - Te = Q\max.Rh \quad (2)$$

When a temperature at the non-sheet-passing portion is To, a temperature at the sheet passing portion is Ti, and ΔT=To−Ti, the following relationship is required to be satisfied.

$$\Delta T \leqq \Delta T\max$$

$$To - Ti \leqq Q\max.Rh$$

$$To \leqq Ti + Q\max.Rh \quad (3)$$

When the heat pipe 81 is not used under a condition that the above relationships (3) is satisfied, a high heat transfer characteristic as a characteristic of the heat pipe 81 cannot be obtained, so that the non-sheet-passing portion temperature rise cannot be sufficiently suppressed.

(Measuring Method)

A measuring method of the maximum heat transport amount Qmax and the heater resistance Rh in the present invention will be described.

As shown in FIG. 4, a periphery of one of end portions of the heat pipe 81 is thermally insulated and heated by a heater. A portion heated by the heater corresponds to an evaporation portion. Further, the other end portion is temperature-controlled to have a fixing temperature. The temperature-controlled portion corresponds to a condensation portion. A distance between the evaporation portion and the condensation portion is placed in a closest state, and an electric power P inputted into the heater is changed. Under this condition, temperatures at which temperatures Te and Tc at the evaporation portion and condensation portion, respectively, for each of inputted electric power values are placed in equilibrium state are measured. The measurement of the temperatures is performed by providing thermocouples to a peripheral surface of the heat pipe at four points. An average of the thus measured values is taken as each of the temperatures Te and Tc.

From the resultant average values, a characteristic curve showing a relationship between Q and Rh is obtained as shown in FIG. 5, wherein the abscissa represents Q=PW (W) and the ordinate represents Rh=(° C.)−Tc (° C.))/PW (W). When the dryout occurs, a slope of the curve is abruptly increased. Before and after the slope is abruptly increased, tangent lines are drawn to obtain an intersection I. At the intersection I, the heat transport amount is taken as Qmax and the heat resistance is taken as Rh during (or immediately after) the occurrence of the dryout. Further, in the following manner, it is also possible to measure the temperature difference ΔTmax (=Qmax.Rh) between the sheet passing portion and the non-sheet-passing portion during the occurrence of the dryout. As shown in Comparative Embodiment 2 in FIG. 9, during the occurrence of the dryout, a temperature increase curve at the non-sheet-passing portion has a change point A from which the temperature is abruptly increased. In an area of the heat pipe corresponding to the sheet passing portion of the small-size recording material, the temperature is controlled so as to have a fixing temperature. The data of temperature of the heat pipe in an area corresponding to the non-sheet-passing portion when the temperature at the non-sheet-passing portion is heated by a predetermined (constant) electric power are plotted. On the resultant curve, a temperature from which a temperature rise rate is abruptly increased may also be taken as a dryout occurrence temperature. As the temperature rise rate, an average of data measured several times is used. In this embodiment, by setting a Curie temperature so as to be lower than the dryout occurrence temperature, it is possible to prevent the occurrence of the dryout or decrease the number of occurrences thereof.

(2-5) Induction Heating of Magnetism-adjusted Alloy Layer 82

A principle of electromagnetic induction heating of the magnetism-adjusted alloy layer 82 will be described with reference to a schematic illustration of FIG. 6.

Figure 6:
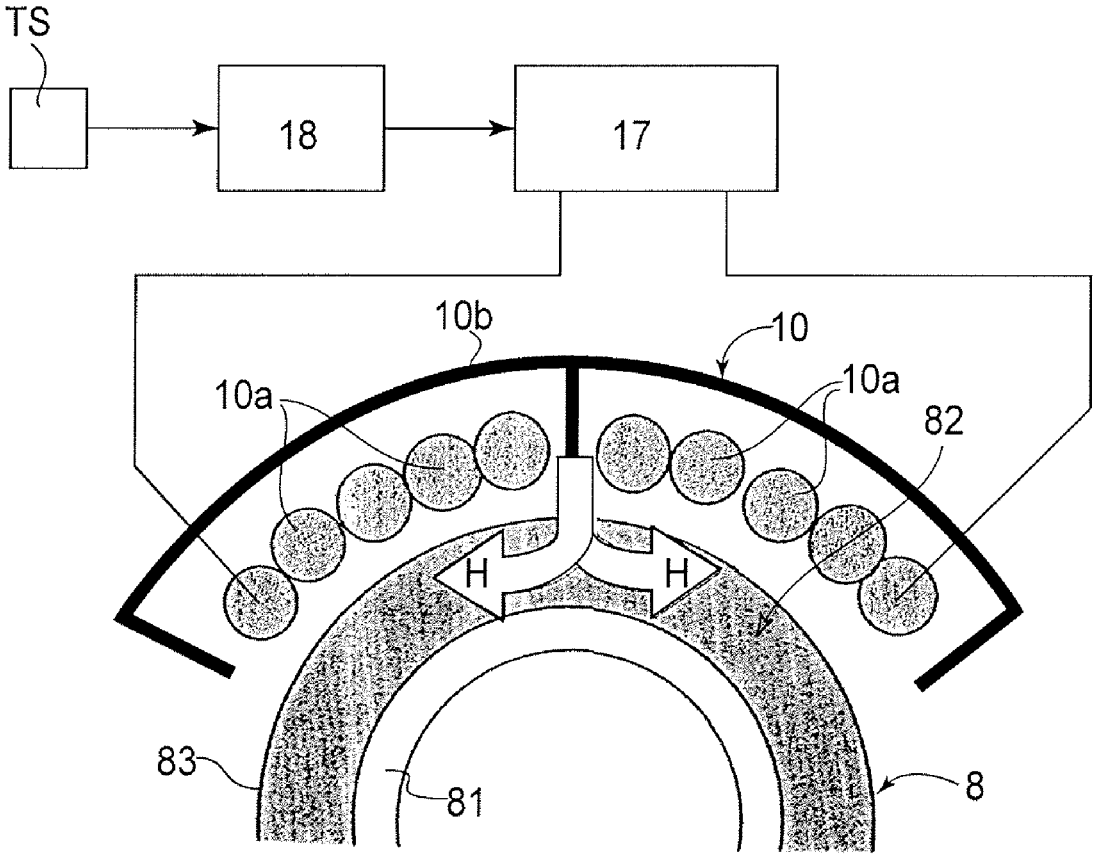
FIG. 6 is a schematic view for illustrating an induction heating principle of a magnetism-adjusted alloy roller.

Referring to FIG. 6, to the induction coil, 10*a* of the induction coil unit 10, an AC current is applied from the high-frequency inverter 17, so that around the induction coil 10*a*, magnetic flux indicated by allows H is repetitively generated and removed. The magnetic flux H is guided along a magnetic patch formed by magnetic core material 10*b* and the magnetism-adjusted alloy layer 82. With respect to the change in magnetic flux generated by the induction coil 10*a*, an eddy current indicated by arrows C is produced in the more metal 1*a* so as to penetrate magnetic flux in a direction of preventing the change in magnetic flux.

The eddy current concentratedly flows the surface of the induction coil 10*a* of the magnetism-adjusted alloy layer 82 by skin effect, whereby heat is generated at a power in proportion to a skin resistance Rs (ohm) of the magnetism-adjusted alloy layer 82.

A skin depth δ (thickness of skin or surface layer) and the skin resistance Rs are represented by the following formulas (4) and (5):

$$\delta = \sqrt{\frac{2\rho}{\omega\mu}}, \quad (4)$$

$$Rs = \frac{\rho}{\delta} = \sqrt{\frac{\omega\mu\rho}{2}}, \quad (5)$$

wherein ω represents an angular frequency of the AC current applied to the induction coil 10*a*, μ represents a permeability of the magnetism-adjusted alloy layer 82, and ρ represents a specific resistance (resistivity) of the magnetism-adjusted alloy layer 82.

A power W generated in the magnetism-adjusted alloy layer 82 is represented by the following formula (6):

$$W \propto Rs \int |If|^2 dS \quad (6),$$

wherein "If" represents an eddy current induced in the magnetism-adjusted alloy layer 82.

From the above formulas (4) to (6), in order to increase a heat generating rate of the magnetism-adjusted alloy layer 82, the eddy current (If) is increased or the skin resistance Rs is increased.

In order to increase the eddy current, magnetic flux H generated by the induction coil 10*a* is increased or the change in magnetic flux H is enlarged. For example, the number of winding of the induction coil 10*a* is increased or as the magnetic core material 10*b*, a material having a higher permeability and a lower residual magnetic flux may preferably be used.

Further, a gap between the magnetic core material 10*b* and the magnetism-adjusted alloy layer 82 is decreased, whereby magnetic flux H induced in the magnetism-adjusted alloy layer 82 is increased, so that the eddy current (If) can be increased.

On the other hand, in order to increase the skin resistance Rs, it is preferable that a frequency of the AC current applied to the induction coil 10*a* is increased or a material which has a higher permeability μ and a higher specific resistance ρ is used for the magnetism-adjusted alloy layer 82.

Generally, ferromagnetic material loses its spontaneous magnetization to decrease its permeability μ when it is heated up to a Curie temperature peculiar to the material. Accordingly, when the temperature of the magnetism-adjusted alloy layer 82 (electroconductive layer) exceeds the Curie temperature, the skin resistance Rs is decreased. Further, the magnetic flux induced in the magnetism-adjusted alloy layer 82 is also decreased, so that the eddy current (If) is also decreased. As a result, a heat generating rate W of the magnetism-adjusted alloy layer 82 is lowered.

Generally, the skin resistance Rs is determined, as shown in the formula (5), by the permeability μ and the resistivity ρ in the case of a constant frequency, and the resistivity is generally moderately increased with temperature increase.

Figure 7:
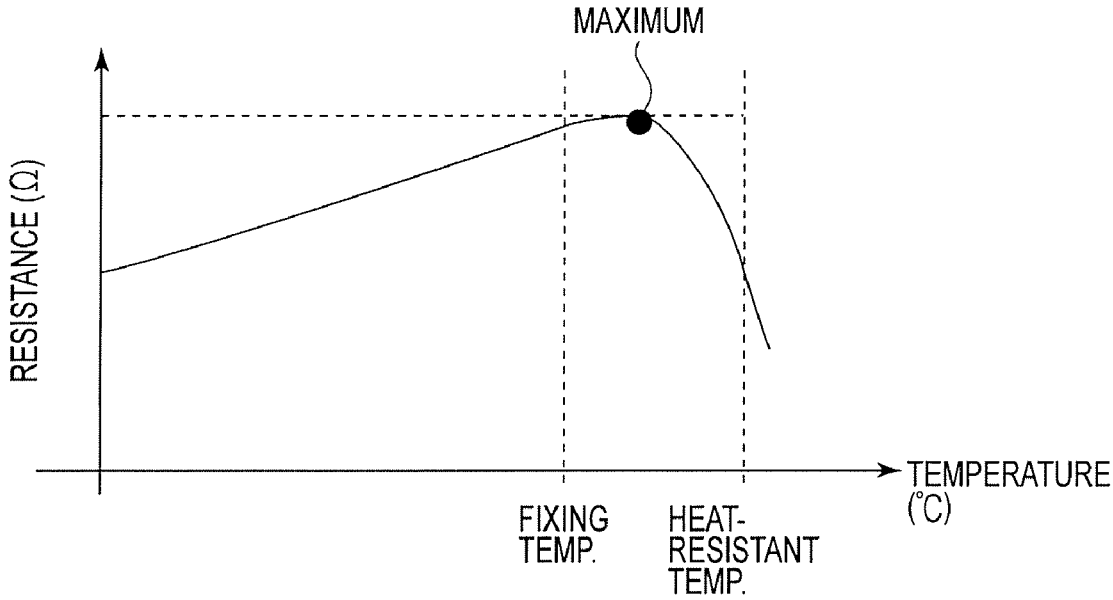
FIG. 7 is a graph showing a temperature dependency curve of a resistance value of a heating roller.

FIG. 7 is a graph showing a temperature-dependent curve of an electrical resistance of the magnetism-adjusted alloy layer 82 in this embodiment.

In the present invention, by using a magnetic-adjusted alloy having a Curie temperature adjusted to be a predetermined temperature as a material for the magnetism-adjusted alloy layer 82, the Curie temperature is not less than a fixation temperature and less than a heat-resistance temperature of the fixing apparatus. As a result, when the temperature of the magnetism-adjusted alloy layer 82 is close to the Curie temperature, the permeability is abruptly lowered with the increase in temperature. For this reason, as shown in FIG. 7, the electric resistance of the magnetism-adjusted alloy layer 82 with respect to the induction coil at least have a temperature range, in which the electric resistance of the magnetism-adjusted alloy layer 82 is decreased, being a range of a temperature lower than the heat-resistant temperature of the fixing apparatus, i.e., the magnetism-adjusted alloy layer resistance has a maximum at a temperature lower than the heat-resistant temperature of the fixing apparatus. As a result, the decrease in electric resistance causes a lowering in heat generating rate. For this reason, different from a conventional magnetism-adjusted alloy roller having an electric resistance which is increased with temperature, the heat generating rate is decreased with temperature rise. As a result, it is possible to alleviate the temperature rise at the non-sheet-passing portion. Further, with the decrease in permeability, an amount of the eddy current is also decreased, so that the heat generating rate is abruptly lowered.

Here, the heat-resistant temperature of the fixing apparatus is a temperature at which a temperature of parts of the apparatus is increased and exceeds breakage or heat-resistant limit when the heating member is increased in temperature by increasing electric power supplied to the apparatus. In this embodiment, a heat-resistant temperature of 235° C. of the heat insulating bushes 12*a* and 12*b* supporting the heating roller 8 as the heating member is taken as the heat-resistant temperature.

The above described magnetism-adjusted alloy layer 82 of the heating roller 8 is constituted as a magnetism-adjusted alloy roller having a Curie temperature which is an image heating temperature (fixing temperature) or more and less than the heat-resistant temperature of the apparatus. Further, in order to reduce the warming-up time, the Curie temperature may desirably be higher than the image heating temperature (fixing temperature).

Further, in order to shorten the warming-up time required for increasing the magnetism-adjusted alloy layer temperature up to the fixing temperature, the temperature for the above described maximum resistance is increased as higher as possible so as to be not less than the fixation temperature. By doing so, the resistance is not decreased until the magnetism-adjusted alloy layer temperature reaches the fixation temperature. As a result, it is possible to perform the heating of the heating roller efficiently.

Further, in such a temperature range that the temperature of the magnetism-adjusted alloy layer is not less than a predetermined fixation temperature and less than the heat-resistant temperature of the fixing apparatus, the material for the heating roller is prepared so that it has a temperature range such that the roller resistance is lower than that at least at the fixation temperature. By doing so, it is possible to decrease the heat generating rate at the non-sheet-passing portion compared with the sheet passing portion. As a result, it is possible to prevent breakage of the heat insulating bushes and the like due to the temperature rise at the non-sheet-passing portion leading to an increase in magnetism-adjusted alloy layer temperature such that the temperature exceeds the heat-resistant temperature of the apparatus.

Herein, the (skin) resistance Rs of the magnetism-adjusted alloy layer 82 corresponds to an apparent load resistance of the magnetism-adjusted alloy layer with respect to the induction coil 10*a* when the induction coil unit 10 is mounted in the heating roller 8 and a current is passed through the induction coil 10*a*.

The apparent (load) resistance and its temperature dependence are determined in the following manner.

By using an LCR meter (Model "HP4194A", mfd. by Agilent Technologies Inc.), an electric resistance of the magnetism-adjusted alloy layer 82 is measured when an AC with a frequency of 20 kHz is applied. In this case, the measurement is performed in such a state that the magnetism-adjusted alloy layer 82 and the induction coil unit 10 (magnetic flux generation means) are mounted in the heating apparatus. While changing the temperature of the magnetism-adjusted alloy layer 82, the temperature and the resistance value of the magnetism-adjusted alloy layer 82 are plotted at the same time, whereby a temperature characteristic curve of the resistance of the magnetism-adjusted alloy layer 82 can be obtained.

The temperature of the magnetism-adjusted alloy layer 82 is changed in such a state that the magnetism-adjusted alloy layer 82 and the induction coil unit 10 are placed in a thermostatic chamber while being mounted in the fixing apparatus so as to keep their positional relationship, so that the temperature of the magnetism-adjusted alloy layer 82 is saturated as a temperature in the thermostatic chamber and then the resistivity is measured in the above described manner.

As described above, as the material for the magnetism-adjusted alloy layer 82, the magnetism-adjusted alloy having a Curie temperature adjusted to be a predetermined temperature, specifically such a temperature that is higher than the fixing temperature as the image heating temperature and in an acceptable temperature rise range for the non-sheet-passing portion temperature rise, is used, whereby a heat generating rate of the magnetism-adjusted alloy layer is abruptly lowered at a temperature close to the Curie temperature. For this reason, even in the case of passing the small-size recording material, it is possible to prevent the breakage of the heat insulating bushes and the like due to the temperature rise at the non-sheet passing portion leading to the increase in magnetism-adjusted alloy layer temperature such that the temperature exceeds the heat-resistant temperature of the apparatus.

As described above, the heat generating rate of the magnetism-adjusted alloy layer 82 is gradually decreased with an increasing temperature of the magnetism-adjusted alloy layer 82, as the electroconductive member of the heating roller 8, up to the Curie temperature. For this reason, when the Curie temperature is substantially equal to the fixing temperature, a quick start performance is impaired. Accordingly, it is desirable that the fixing temperature is set to be lower than the Curie temperature.

In this embodiment, the Curie temperature of the magnetism-adjusted alloy layer 82 as the electroconductive member of the heating roller 8 is set to 210° C., and the fixing temperature of the heating roller 8 is set to 190° C.

Herein, the fixing temperature means a target temperature of the heating roller 8, to be controlled by energization, at the time of fixing the toner on the recording material. In this embodiment, the fixing temperature (190° C.) may be appropriately changed. For example, the present invention is applicable even when a plurality of fixing temperatures is set depending on the thickness of the recording material to be conveyed or a thermal storage state of the heating roller 8. In this case, when the above described relationship is satisfied with respect to at least one of the plurality of fixing temperatures, the effect of the present invention can be achieved.

In the present invention, the permeability is measured in the following manner by use of B-H analyzer (Model "SY-8232", mfd. by Iwatsu Test Instruments Co.).

Around a measuring sample, predetermined primary and secondary coils of a measuring apparatus are wound and subjected to measurement at a frequency of 20 kHz. With respect to the measuring sample, it is possible to use any material so long as it has such a shape that the coils can be wound around it since a ratio between temperatures at which permeabilities are different from each other is little changed.

Figure 8:
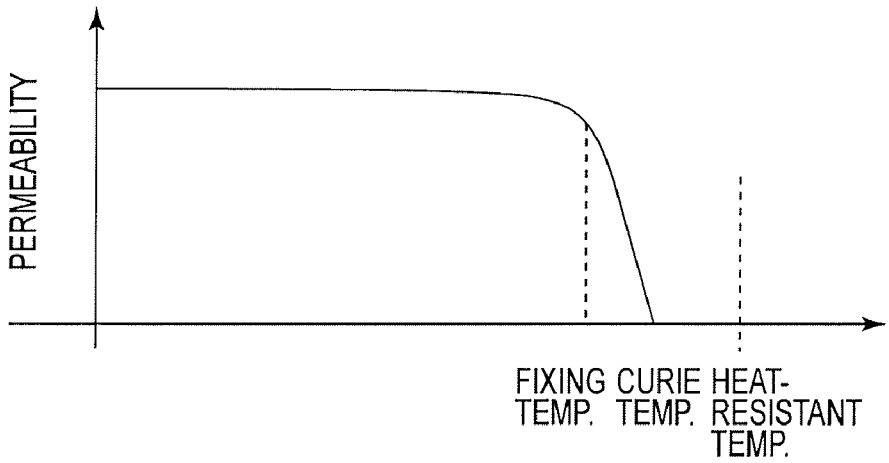
FIG. 8 is a graph showing a temperature dependency curve of a permeability of the heating roller.

After completion of the winding of the coils around the measuring sample, the sample is placed in a thermostatic chamber to saturate the temperature. Then, permeability at the saturation temperature is plotted. By changing the temperature in the thermostatic chamber, it is possible to obtain a temperature-dependent curve of the permeability. The temperature at which the permeability is 1 is taken as a Curie temperature, and is determined in the following manner. When the temperature in the thermostatic chamber is increased, the permeability does not change at a certain temperature. This temperature is regarded as a Curie temperature, i.e., a temperature at which the permeability is 1. The thus measured temperature-dependent permeability is shown by a curve indicated in FIG. 8.

(2-6) Test Example 1

Embodiment 1

Fixing apparatus constituted as described above

Comparative Embodiment 1

Fixing apparatus using an iron roller as the heating roller 8 in Embodiment 1

Comparative Embodiment 2

Fixing apparatus using only an iron-made heat pipe as the heating roller 8 in Embodiment 1

Comparative Embodiment 3

Fixing apparatus having the same constitution as in Embodiment 1 except that the Curie temperature of the magnetism-adjusted alloy layer 82 is changed to 220° C.

In each of the above fixing apparatuses of Embodiment 1 and Comparative Embodiments 1 to 3, 500 sheets of A4-size paper as the small-size recording material were continuously conveyed in portrait orientation (A4R) and fixed, and thereafter blank rotation was effected. Incidentally, in each embodiment, the same surface layer of the heating roller 8 is used.

(Sheet Passing Condition)
process speed: 300 mm/sec
productivity: 30 cpm

Figure 9:
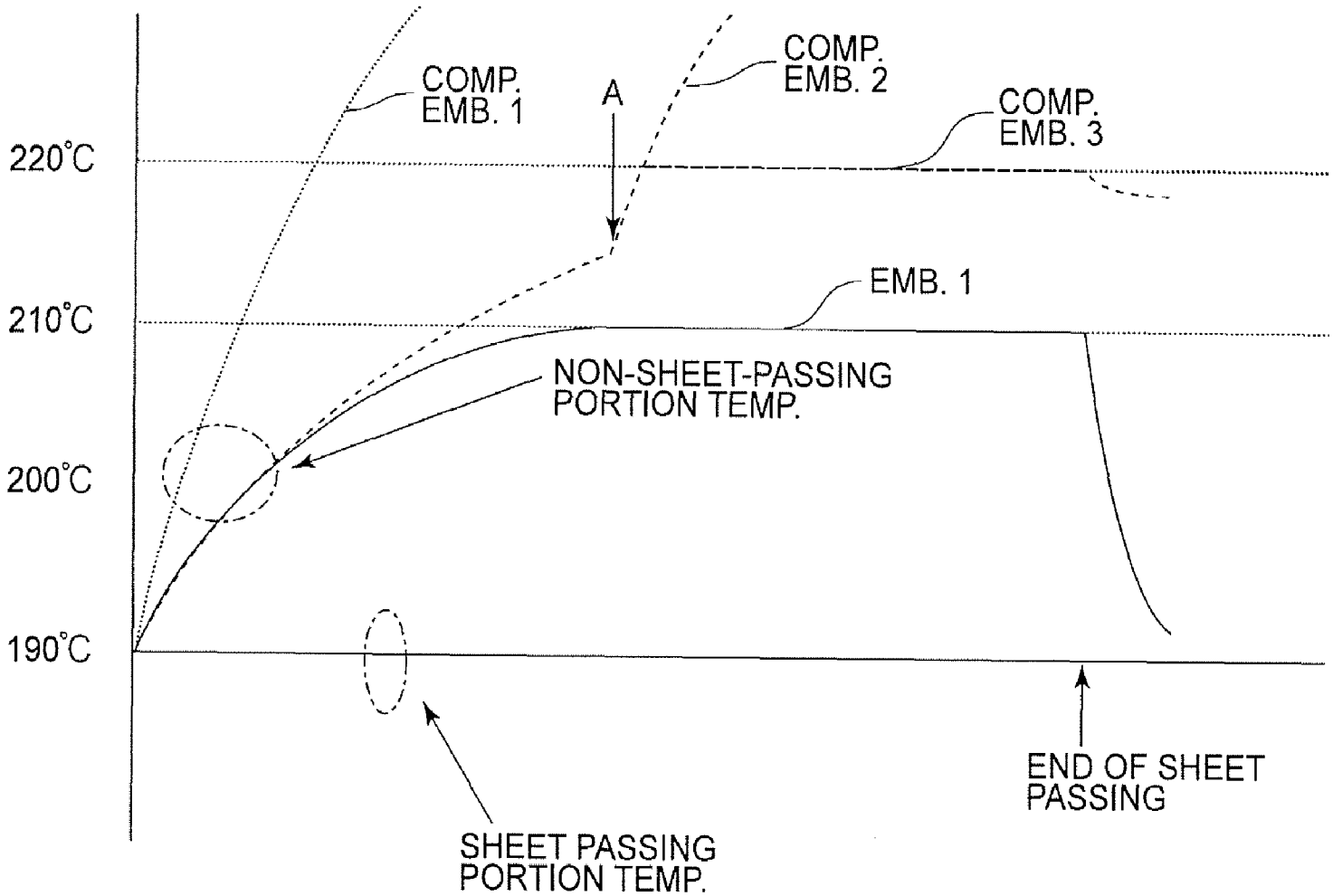
FIG. 9 is a schematic illustration of temperature changes at a sheet passing portion and non-sheet-passing portion in fixing apparatuses according to Embodiment 1 and Comparative Embodiments 1 to 3.

In Test Example 1, changes with time of surface temperatures of the respective heating rollers of the fixing apparatuses of Embodiment 1 and Comparative Embodiments 1 to 3 are shown in FIG. 9.

In Test Example 1, the sheet passing portion (area) temperature was about 190° C. in either of the fixing apparatuses of Embodiment 1 and Comparative Embodiments 1 to 3, thus being stable.

In the fixing apparatus of Comparative Embodiment 1 using the iron roller as the heating roller 8, the non-sheet-passing portion temperature was increased continuously and exceeded the heat-resistant temperature of the apparatus (235° C.) to cause breakage of the heat insulating bushes 12*a* and 12*b*.

In the fixing apparatus of Comparative Embodiment 2 using only the heat pipe as the heating roller 8, the non-sheet-passing portion temperature exceeded 235° C. to cause breakage of the heat insulating bushes 12*a* and 12*b*. As shown in FIG. 9, the non-sheet-passing portion temperature is abruptly increased from a point A. This is because an amount of heat dissipated at the sheet passing portion is large, so that an amount of heat generation at the non-sheet-passing portion is increased. In Comparative Embodiment 2, from the results of Embodiment 5, the heating roller 81 has a maximum heat transport amount Qmax of about 100 (W) and heat resistance Rh of 0.25 (° C./W). Further, from the results of FIG. 9, the sheet passing portion temperature Ti is 190° C.

With respect to the non-sheet-passing portion temperature To not less than 215° C. at the point A in FIG. 9, the amount of heat transport of the heat pipe 81 exceeds the maximum heat transport amount Qmax in an area satisfying the following relationships:

$$Qmax.Rh=25°\ C., \text{ and}$$

$$To>215°\ C.=Ti+Qmax.Rh.$$

As a result, the heat pipe 81 causes the dryout, so that thereafter the heat pipe 8 does not sufficiently function as a heat pipe.

In Comparative Embodiment 3, the magnetism-adjusted alloy layer 82 of the heating roller 8 is changed from that having the adjusted Curie temperature of 210° C. in Embodiment 1 to that having the adjusted Curie temperature of 220° C. For this reason, in the fixing apparatus of Comparative Embodiment 3, at the non-sheet-passing portion, the amount of heat generation is abruptly lowered at the Curie temperature of 220° C. or a temperature close thereto as described above. For this reason, the non-sheet-passing portion temperature is lower than the heat-resistant temperature of 235° C., so that the heat insulating bushes 12*a* and 12*b* were not broken.

However, in Comparative Embodiment 3, from the results of FIG. 9, the non-sheet-passing portion temperature To=Curie temperature Tcr=220° C. and the sheet passing portion temperature Ti=190° C. are satisfied. For this reason, the non-sheet-passing portion temperature is higher than 215° C. (at the point A in FIG. 9), i.e., the following relationship is satisfied:

$$Tcr=220°\ C.>Ti+Q\max.Rh=215°\ C.$$

Accordingly, the amount of heat transport of the heat pipe 81 exceeds the maximum heat transport amount Qmax. As a result, the heat pipe 81 causes the dryout, so that it does not sufficiently function as a heat pipe.

Further, A3-size sheet as the large-size recording material was passed through the fixing apparatus of Comparative Embodiment 5 after the lapse of 5 sec from completion of Test Example 1. As a result, high-temperature offset (hot offset) occurred at end portions (non-sheet-passing portions of A4R-sheet). This is because a temperature uniformizing effect is small in the magnetism-adjusted alloy layer 82 compared with the heat pipe 81, so that the non-sheet-passing portion temperature is not readily lowered even when the blank rotation is effected after the passing of the small-size recording material.

In the fixing apparatus of Embodiment 1, the heating roller 8 includes the heat pipe 81 having a large heat transportability and the magnetism-adjusted alloy layer 82. In Embodiment 1, from the results of FIG. 9, the non-sheet-passing portion temperature To=Curie temperature Tcr=210° C. and the sheet passing temperature Ti=190° C. are satisfied.

In this case, the following relationship is satisfied:

$$Ti \leqq Tcr \leqq Qmax.Rh=215°\ C.$$

For this reason, the amount of heat transport of the heating roller 81 is smaller than the maximum heat transport amount Qmax and at the non-sheet-passing portion, the amount of heat generation is abruptly lowered at about 210° C. (Curie temperature). As a result, the non-sheet-passing portion temperature rise is suppressed, so that it is possible to prevent the dryout in the heat pipe 81. Particularly, the constitution of the fixing apparatus of Embodiment 1 is capable of satisfying the above described relationship (6).

As a result, even when the large-size (A3) recording material is passed through the fixing apparatus (of Embodiment 1) after the lapse of 5 sec from the blank rotation after the passing of the small-size (A4R) recording material, the heat pipe 81 has the temperature uniformizing effect. As a result, there was no occurrence of the hot offset at end portions (non-sheet-passing portions of A4R-sheet).

As described above, the heating roller 8 as the heating member includes the heat pipe 81 and the magnetism-adjusted alloy layer 82 formed of a material having a Curie temperature which is not less than the image heating temperature (or more than the image heating temperature) and is less than the heat-resistant temperature of the fixing apparatus. The fixing apparatus including the electromagnetic induction heating means for heating the heating roller 8 cause no increase in warming-up time (WUT) by setting the Curie temperature (Curie point) of the heating roller 8 so as to be higher than the fixing temperature. Further, it is possible to prevent the occurrence of the dryout in the heat pipe 81. For this reason, it is also possible to prevent an occurrence of image failure such as the hot offset even in the case where the large-size recording material is passed through the fixing apparatus after the continuous passing of the small-size recording material having a sheet width smaller than a heating roller width.

Further, in this embodiment, the material for the heat pipe 81 is copper but the heat pipe 81 itself may also be formed of the magnetism-adjusted alloy, so that it is possible to constitute an inexpensive heat pipe with lower thermal capacity. More specifically, the cylindrical pipe for the heat pipe 81 is constituted by an induction heating member having a Curie temperature in a range such that it is the image heating temperature or more and is less than the heat-resistant temperature of the fixing apparatus. Alternatively, the cylindrical pipe is constituted by an induction heating member having a temperature characteristic such that there is a temperature area in which the electric resistance is decreased with an increase in temperature and that the electric resistance has a maximum between the image heating temperature and the heat-resistant temperature of the fixing apparatus.

Embodiment 2

Figure 10:
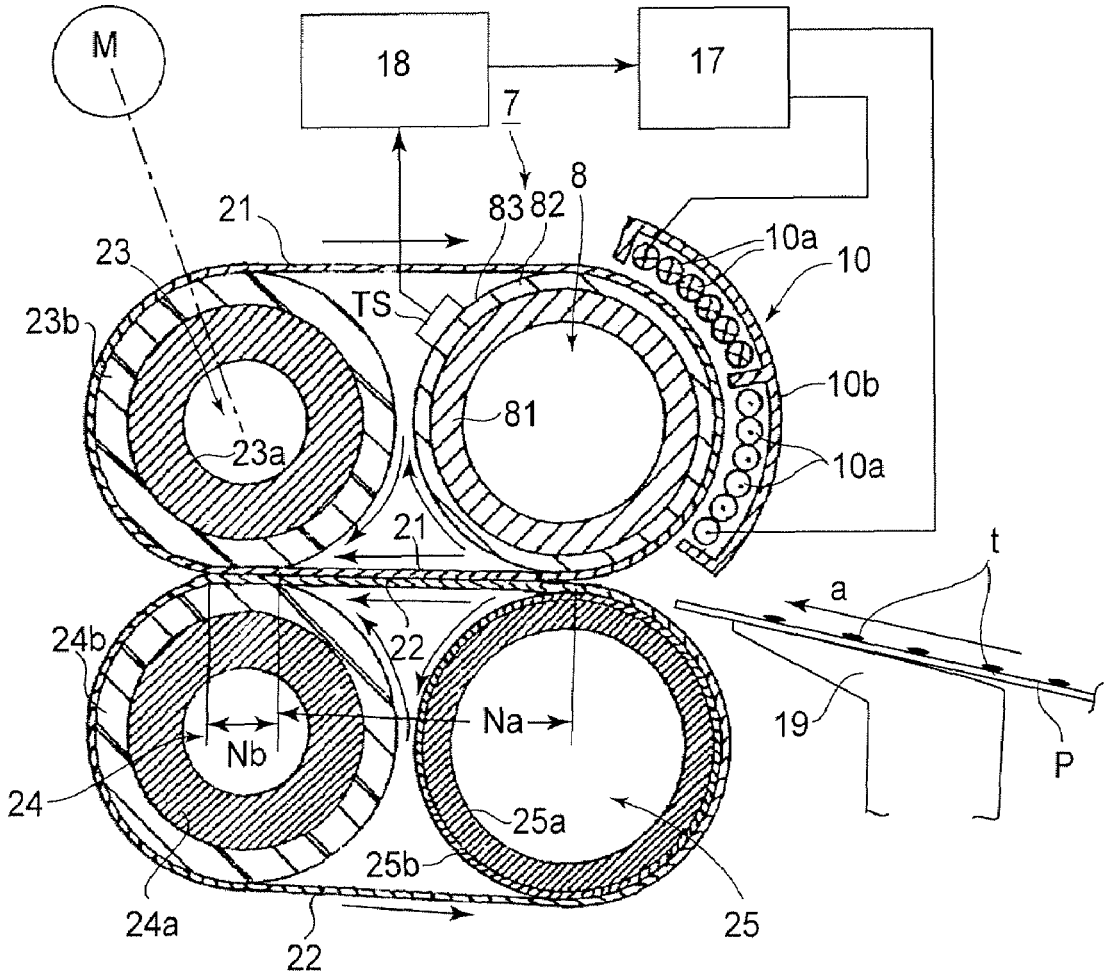
FIGS. 10, 11 and 12 are enlarged sectional views each for illustrating a principal portion of a fixing apparatus in Embodiment 2.

FIG. 10 is a schematic front view of a principal portion of a fixing apparatus 7 in this embodiment. The fixing apparatus 7 is of a belt fixation type.

Referring to FIG. 10, the fixing apparatus 7 includes an endless belt (hereinafter referred to as a "fixing belt") 21 for heating an image on a recording material and another endless belt (hereinafter referred to as a "pressing belt") 22 for creating a nip between it and the fixing belt 21. The fixing belt 21 is extended and stretched by a fixing roller 23 and a heating roller 8. The pressing belt 22 is extended and stretched by a backup roller 24 and a tension roller 25. The fixing belt 21 and the pressing belt 22 are disposed in such a manner that they contact each other so that a nip is created between a lower surface of the fixing belt 21 and an upper surface of the pressing belt 22. More specifically, a fixing nip (primary nip) Nb is created between the fixing roller 23 and the backup roller 24 via the fixing belt 21 and the pressing belt 22 by pressing the rollers 23 and 24 against each other with resistance to elasticity of both of the rollers 23 and 24. Further, an auxiliary nip Na is created at a portion upstream from the fixing nip Nb in a belt moving direction by bringing the fixing belt 21 and the pressing belt into contact with each other.

Further, at a portion where the fixing belt 21 is wound around the heating roller 8, outside the fixing belt 21, an induction coil unit 10 as an electromagnetic induction heating means for heating the heating roller 8 is disposed. The induction coil unit 10 is disposed opposite to the fixing belt 21 with a predetermined spacing (gap) therebetween. In other words, the induction coil unit 10 (electromagnetic induction heating means) is disposed so as to surround an outer peripheral surface of the heating roller 8 with a spacing.

The fixing roller 23 is rotationally driven in a clockwise direction indicated by an arrow shown in FIG. 10 at a predetermined speed by transmitting a rotational force from a driving motor M via an unshown power transmitting mechanism. By the rotational drive of the fixing roller 23, the fixing belt 21 and the heating roller 8 are rotationally driven. Further, by the rotation of the fixing belt 21, a frictional force is produced between the fixing belt 21 and the pressing belt 22 in the nips Na and Nb, whereby the pressing belt 22 and the backup roller 24 and tension roller 25 which stretch the pressing belt 22 are rotated. It is also possible to rotate the fixing belt 21 and the pressing belt 24 by driving both of the fixing roller 23 and the backup roller 24. Alternatively, it is also possible to employ such an apparatus constitution that the fixing belt 21 and the pressing belt 22 are rotated by driving only the backup roller 24.

An AC current is carried from a high-frequency inverter 17 to induction coils 10*a* of the induction coil unit 10, so that an AC magnetic field is generated to increase a temperature of the heating roller 8 by electromagnetic induction heating. The surface temperature of the heating roller 8 is detected by a temperature sensor TS as a temperature detection means disposed in contact or noncontact with the heating roller 8. Then, electrical information about the detection temperature of the temperature sensor TS is inputted into a control circuit 18. The control circuit 18 controls electric power supplied from the high-frequency inverter 17 to the induction coils 10*a* at the induction coil unit 10 so that the electrical information about the detection temperature inputted from the temperature sensor TS is kept at a substantially constant value. As a result, the surface temperature of the heating roller 8 is temperature-controlled at a predetermined fixing temperature, so that the fixing belt 21 is heated by the heating roller 8.

Then, the recording material P onto which the toner image t has been transferred at the transfer nip T as described above, is introduced into the auxiliary nip Na by being guided through an entrance guide plate 19. The toner image (or color toner image) t on the recording material P is fixed as a permanent fixed image under heating by the fixing belt 21 and pressure in the fixing nip N during the nipping and conveyance of the recording material P in the auxiliary nip Na and the fixing nip Nb.

In this embodiment, the heating roller 8 has the same constitution as that in Embodiment 1. More specifically, the heating roller 8 is constituted as a roller member having an outer diameter of approximately 10 mm and a three-layer structure consisting of a heat pipe 81, a magnetism-adjusted alloy layer 82, and a surface coating layer 83 in this order from an inner side to an outer side.

The magnetism-adjusted alloy layer 82 has such a characteristic that a change point of permeability at the fixing temperature or more or a temperature higher than the fixing temperature and the permeability is 1 at a temperature not less than a breakage temperature of the fixing apparatus. Alternatively, the magnetism-adjusted alloy layer 82 has a temperature characteristic such that an electric resistance is decreased with an increase in temperature in a temperature range and has a maximum at a temperature between the image heating temperature and the heat-resistant temperature of the apparatus. Accordingly, it is possible to achieve the same effect as the constitution described in Embodiment 1.

Further, in this embodiment, the induction coil unit 10 as the electromagnetic induction heating means for heating the heating roller 8 has also the same constitution as that in Embodiment 1, thus including the magnetic core 10*b* and the induction coils 10*a*.

The fixing belt 21 has the following three layer structure.

As a base member, an electro-formed belt of nickel having an inner diameter of about 30 mm and a thickness of about 30 μm is used. Outside (at an outer peripheral surface of) the base member, a silicone rubber layer having a thickness of about 300 μm is coated as a rubber layer. Further, on the surface of the rubber layer, as a release layer, a coating layer of fluoroplastic such as perfluoroalkoxy (PFA) or polytetrafluoroethylene (PTFE) or a PFA tube is coated in a thickness of about 30 μm.

The base member of the fixing belt 21 to be wound around the heating roller 8 may only be required that it is constituted so that the heating roller 8 is induction-heated by the induction coils 10*a* of the induction coil unit 10 disposed outside the heating roller 8. In the case of the nickel-made electro-formed belt, the heating roller 8 is sufficiently heated by leakage flux passing through the electro-formed belt when it has a thickness of about 20-100 μm. Further, as the base member for the fixing belt 21, it is also possible to use a heat-resistant resin belt formed of polyimide or the like in a thickness of about 90 μm.

As the pressing belt 22, a belt having a two-layer structure or the like shown below is used.

As a base member, a heat-resistant belt formed of polyimide or the like in a thickness of about 90 μm is used. Further, on the surface of the base member, as a release layer, a coating layer of fluoroplastic such as perfluoroalkoxy (PFA) or polytetrafluoro-ethylene (PTFE) or a PFA tube is coated in a thickness of about 30 μm.

The fixing roller 23 is, e.g., constituted as a soft roller, having an outer diameter of about 10 mm, including a cylindrical metal pipe as a core metal 23*a* formed of steed materials such as STKM (carbon steel tubes for machine structural purposes) in a thickness of about 2 mm and at an outer peripheral surface thereof, a silicone rubber layer 23*b* having a thickness of about 1 mm.

The backup roller 24 has the same constitution as the fixing roller 23, thus including a metal pipe 24*a* and a silicone rubber layer 24*b*.

The tension roller 25 is, e.g., constituted as a soft roller, having an outer diameter of about 10 mm, including a cylindrical metal pipe as a core metal 25*a* formed of steed materials such as STKM in a thickness of about 1 mm and at an outer peripheral surface thereof, a PFA coating layer 25*b* having a thickness of about 20 μm.

Figure 11:
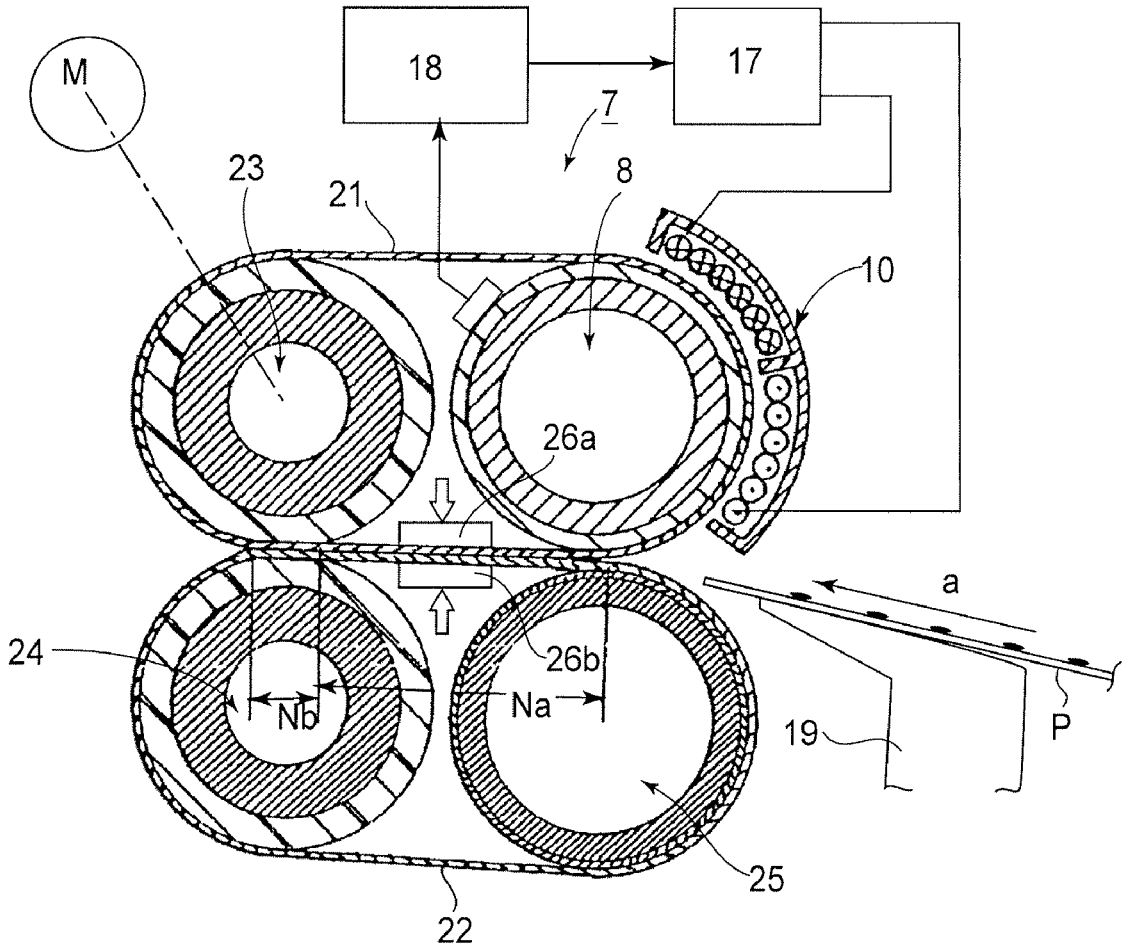

Further, in order to stably create the auxiliary nip Na between the fixing belt 21 and the pressing belt 22, as shown in FIG. 11, it is also possible to dispose auxiliary pads 26*a* and 26*b* opposite to the fixing belt 21 and the pressing belt 22, respectively.

In the fixing apparatus of the belt fixation type in this embodiment, the auxiliary nip Na is effective in ensuring a long heating time with a small roller diameter of the fixing roller 23, so that productivity is further enhanced.

In this embodiment, the case where the fixing nip Nb and the auxiliary nip Na are created by pressing the fixing roller 23 and the backup roller 24 against the fixing belt 21 and the pressing belt 22 is described.

Figure 12:
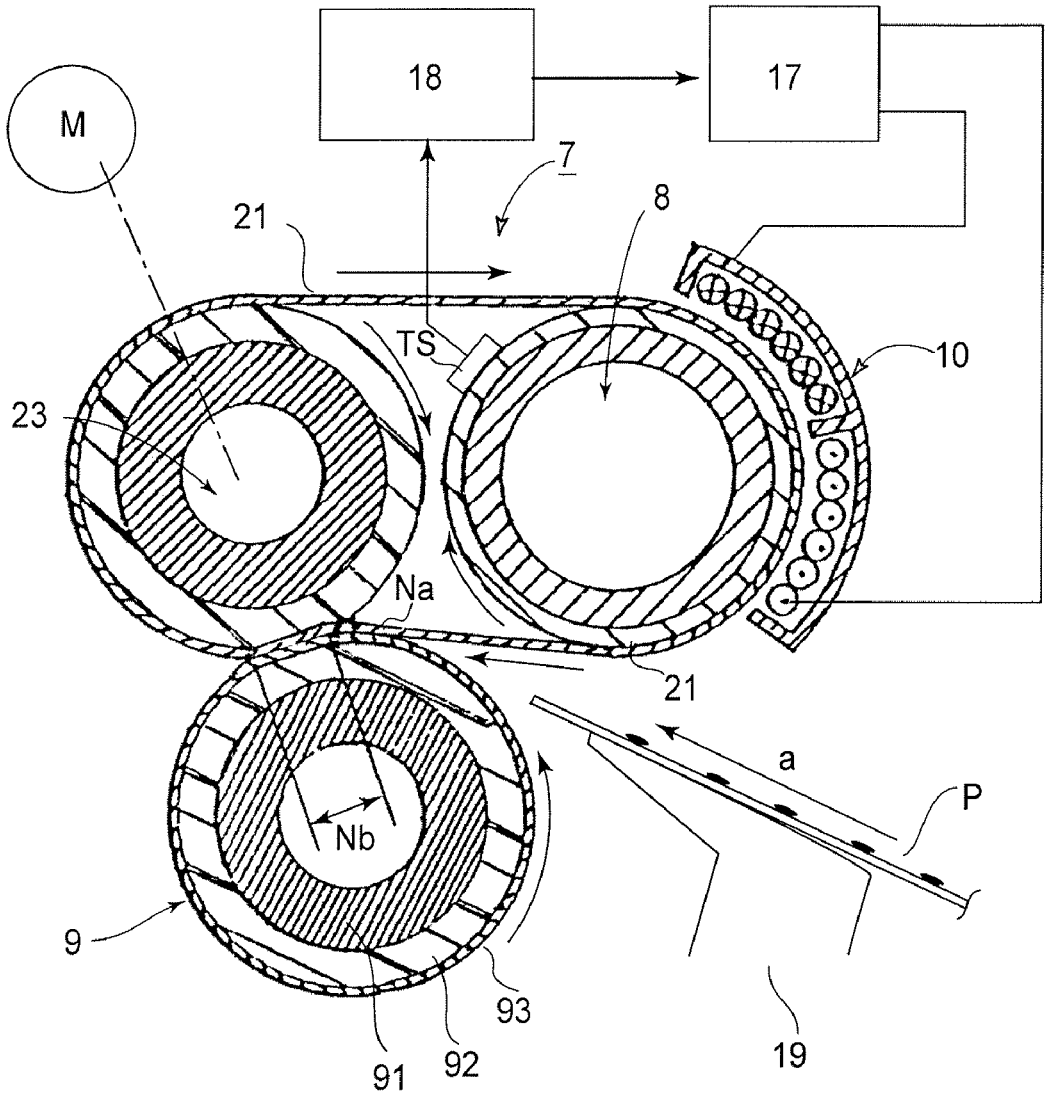

As shown in FIG. 12, it is also possible to create the fixing nip Nb by using the pressing roller 9, used in Embodiment 1, instead of the pressing belt 22, so that the fixing belt 21 is sandwiched between the pressing roller 9 and the fixing roller 23 under pressure application.

Also in the fixing apparatus of this embodiment, the heating roller 8 as the heating member includes the heat pipe 81 and the magnetism-adjusted alloy layer 82 formed of a material having a Curie temperature which is not less than the image heating temperature (or more than the image heating temperature) and is less than the heat-resistant temperature of the fixing apparatus. Alternatively, the heating roller 8 included the magnetism-adjusted alloy layer 82 having a temperature characteristic such that there is a temperature area in which the electric resistance is decreased with an increase in temperature and that the electric resistance has a maximum between the image heating temperature and the heat-resistant temperature of the fixing apparatus. The fixing apparatus includes the electromagnetic induction heating means for heating the heating roller 8. Accordingly, it is possible to set a self-temperature control temperature to be higher than the hot offset temperature, thus causing no increase in warming-up time (WUT). Further, it is possible to prevent the occurrence of the dryout in the heat pipe. For this reason, it is also possible to prevent an occurrence of image failure such as the hot offset even in the case where the large-size recording material is passed through the fixing apparatus after the continuous passing of the small-size recording material having a sheet width smaller than a heating roller width.

Further, in this embodiment, the material for the heat pipe 81, copper is used.

However, by using a magnetism-adjusted alloy material, as the material itself for the heat pipe 81, it is also possible to constitute the heating roller 8 having a lower thermal capacity. More specifically, the cylindrical pipe of the heat pipe 81 is constituted by an induction heat generation member having a Curie temperature which is an image heating temperature or more and a heat-resistant temperature or less of the apparatus or by an induction heat generation member having such a temperature characteristic that there is a temperature range in which an electric resistance value is decreased with an increasing temperature and that the electric resistance value reaches a maximum between the image heating temperature and the heat-resistant temperature of the apparatus.

In the above described embodiments, the passing of the recording material through the fixing apparatus is effected according to the center line-based sheet passing but the present invention may also be applicable to a fixing apparatus employing one end (side) line-based sheet passing, so that a similar effect can be achieved.

Figure 13:
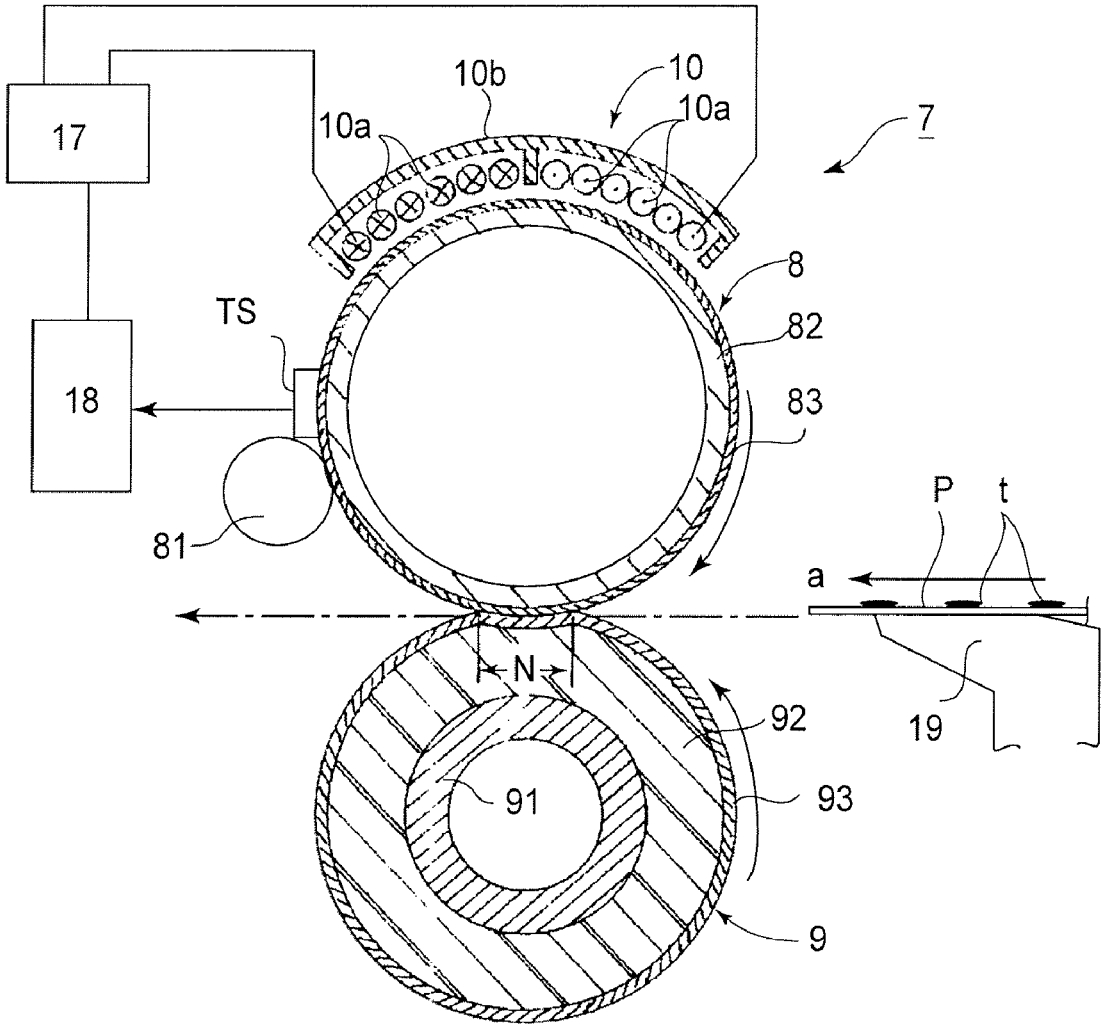
FIG. 13 is a schematic sectional view for illustrating such a constitution that a heat pipe is caused to contact an outer peripheral surface of a roller.
Figure 14:
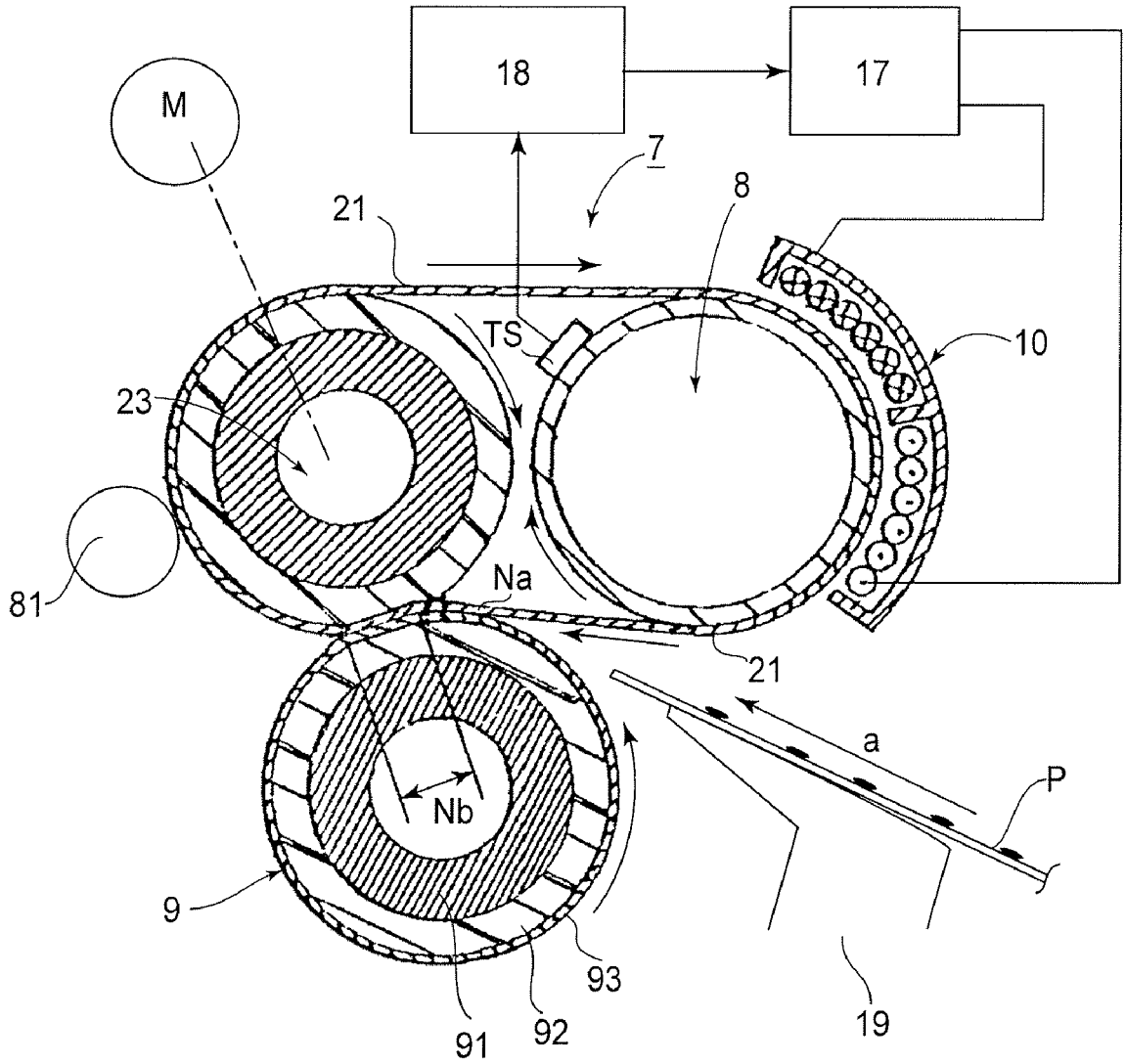
FIG. 14 is a schematic sectional view for illustrating such a constitution that a heat pipe is caused to contact an outer peripheral surface of a belt.

In the above described embodiments, the heat pipe is provided inside the electroconductive layer but in the case of using the roller, the heat pipe may also contact the outer surface of the roller. For example, as shown in FIG. 13, the heat pipe 81 may be disposed at the outer peripheral surface of an image heating member 8. The fixing apparatus 7 shown in FIG. 13 has the same constitution as that shown in FIG. 2 with respect to other portions or members. Further, in the case of using a belt, the heat pipe 81 can be brought into contact with the fixing belt 21 with no problem. Other portions or members of a constitution shown in FIG. 14 are the same as those in FIG. 12. In the case of the constitution shown in FIGS. 13 and 14, it is also possible to effect on-off control of the heat pipe 81 with respect to the image heating member, so that the warming-up time of the fixing apparatus can be reduced.

As described hereinabove, according to the present invention, it is possible to prevent the dryout in the heat pipe even when the non-sheet-passing portion temperature rise occurs due to the continuous passing of the small-size recording material, so that the operating temperature can be easily returned to an ordinary target temperature by the action of the heat pipe.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 352344/2006 filed Dec. 6, 2005, which is hereby incorporated by reference.

What is claimed is:

1. An image heating apparatus, comprising:

a coil for generating magnetic flux;

an image heating member, comprising an electroconductive layer which generates heat by eddy current generated by the magnetic flux from said coil, for heating an image on a recording material;

energization control means for controlling energization of said coil so that a temperature of said image heating member is a a predetermined temperature Tf (° C.) to heat the image; and a heat pipe contactable with said image heating member, wherein the electroconductive layer has a Curie temperature Tc satisfying the following relationship:

$$Tf \leqq Tc \leqq Tf + Q\max(W) \times Rh(° C./W),$$

wherein Qmax (W) represents a maximum amount of heat transport, and Rh (° C./W) represents a value of heat resistance of said heat pipe at a dry out occurrence temperature of said heat pipe.

2. An apparatus according to claim 1, wherein said heat pipe has a diameter of 3 mm or more and 40 mm or less.

3. An apparatus according to claim 1, wherein the Curie temperature Tc of the electroconductive layer is higher than the predetermined temperature.

4. An apparatus according to claim 1, wherein said heat pipe has a length in a longitudinal direction of said image heating member that is larger than a width of the recording material, capable of passing through said image heating apparatus, in a direction perpendicular to a conveyance direction of the recording material.

5. An apparatus according to claim 1, wherein said heat pipe is disposed inside the electroconductive layer of said image heating member.

6. An apparatus according to claim 1, wherein said heat pipe contacts a surface of said image heating member.

7. An apparatus according to claim 1, wherein said image heating member supports a belt contactable with the recording material, the belt having an electroconductive layer which generates heat by the magnetic flux from said coil.

8. An image heating apparatus, comprising:

a coil for generating magnetic flux;

an image heating member, comprising an electroconductive layer which generates heat by eddy current generated by the magnetic flux from said coil, for heating an image on a recording material;

energization control means for controlling energization of said coil so that a temperature of said image heating member is a a predetermined temperature Tf (° C.) to heat the image; and a heat pipe contactable with said image heating member, wherein the electroconductive layer has a Curie temperature which is not less than the predetermined temperature and is not more than a dryout occurrence temperature of said heat pipe when a part of said heat pipe is temperature-controlled to have the predetermined temperature.

9. An apparatus according to claim 8, wherein the dryout occurrence temperature is a temperature at which a temperature rising ratio in an area of said heat pipe corresponding to a non-sheet-passing portion of a small-size recording material is increased when said heat pipe is temperature-controlled to have the predetermined temperature in an area thereof corresponding to a sheet passing portion of the small-size recording material and is heated at constant electric power in the area thereof corresponding to the non-sheet-passing portion of the small-size recording material.

* * * * *